US007122108B2

(12) United States Patent
Heber et al.

(10) Patent No.: US 7,122,108 B2
(45) Date of Patent: Oct. 17, 2006

(54) TIN-SILVER ELECTROLYTE

(75) Inventors: Jochen Heber, Neuenbuerg (DE); André Egli, Richterswil (CH)

(73) Assignee: Shipley Company, L.L.C., Marlborough, MA (US)

( * ) Notice: Subject to any disclaimer, the term of this patent is extended or adjusted under 35 U.S.C. 154(b) by 0 days.

(21) Appl. No.: 10/412,629

(22) Filed: Apr. 11, 2003

(65) Prior Publication Data

US 2006/0027461 A1 Feb. 9, 2006

Related U.S. Application Data

(63) Continuation-in-part of application No. 10/279,671, filed on Oct. 24, 2002, now Pat. No. 6,824,597.

(60) Provisional application No. 60/335,145, filed on Oct. 24, 2001.

(51) Int. Cl.
*C25D 3/60* (2006.01)
*C25D 3/56* (2006.01)
*C23C 18/00* (2006.01)

(52) U.S. Cl. ..... 205/253; 205/259; 106/1.26; 106/1.28

(58) Field of Classification Search ..... 106/1.26, 106/1.28; 205/252, 253, 255, 259
See application file for complete search history.

(56) References Cited

U.S. PATENT DOCUMENTS

| | | | | |
|---|---|---|---|---|
| 3,881,939 | A | 5/1975 | Noda et al. | 96/109 |
| 4,246,077 | A | 1/1981 | Hradil et al. | |
| 4,378,424 | A | 3/1983 | Altland et al. | 430/352 |
| 4,582,576 | A | 4/1986 | Opaskar et al. | |
| 4,686,017 | A | 8/1987 | Young | 204/451 |
| 4,871,429 | A | 10/1989 | Nobel et al. | |
| 5,220,030 | A | 6/1993 | Deaton | 548/105 |
| 5,378,347 | A | 1/1995 | Thomson et al. | 205/254 |
| 5,401,621 | A | 3/1995 | Kojima et al. | 430/393 |
| 5,514,261 | A | 5/1996 | Herklotz et al. | 205/238 |
| 5,776,666 | A | 7/1998 | Texter et al. | 430/445 |
| 5,804,358 | A | 9/1998 | Komatsu et al. | 430/465 |
| 5,948,235 | A | 9/1999 | Arai | 205/252 |
| 6,099,713 | A | 8/2000 | Yanada et al. | 205/253 |
| 6,140,035 | A | 10/2000 | Klingman et al. | 430/574 |
| 6,174,643 | B1 | 1/2001 | Kiyoyama et al. | 430/204 |
| 6,322,686 | B1 | 11/2001 | Brown et al. | 205/253 |
| 6,342,148 | B1 | 1/2002 | Chiu et al. | 205/302 |
| 6,527,840 | B1 | 3/2003 | Igarashi et al. | 106/1.23 |
| 6,736,954 | B1 * | 5/2004 | Cobley et al. | 205/238 |

FOREIGN PATENT DOCUMENTS

| | | |
|---|---|---|
| DE | 43 30 068 A1 | 3/1995 |
| EP | 0 854 206 B1 | 8/2001 |
| JP | 9-143786 | 6/1997 |

OTHER PUBLICATIONS

Deaton et al.; "Gold(I) coordination compounds with mesoionic thiolate ligands and the crystal and molecular structure of bis(1,4,5-trimethyl-1,2,4-triazolium-3-thiolate)gold(I) tetrafluoroborate"; J. Chem. Soc., Dalton Trans., 1999, pp. 3163-3167, no month.

Lira et al.; "Synthesis and Characterization of some New Mesoionic 1,3-Thiazolium-5-thiolates via Cyclodehydration and *in situ* 1,3-Dipolar Cycloaddition/Cycloreversion"; Molecules, 2002, 7, pp. 791-800, no month.

* cited by examiner

*Primary Examiner*—Edna Wong
(74) *Attorney, Agent, or Firm*—John J. Piskorski

(57) ABSTRACT

A tin-silver electrolyte and methods of depositing tin-silver alloys on a substrate.

17 Claims, No Drawings

TIN-SILVER ELECTROLYTE

The present application is a continuation-in-part application of U.S. Ser. No. 10/279,671 filed Oct. 24, 2002 now U.S. Pat. No. 6,824,597 which is a non-provisional of provisional application Ser. No. 60/335,145 filed Oct. 24, 2001.

BACKGROUND OF THE INVENTION

The present invention is directed to a tin-silver electrolyte. More specifically the present invention is directed to a tin-silver electrolyte that enhances tin-silver alloy deposition on a substrate.

Tin-silver alloy deposition processes have been used in a number of applications requiring attachment of electronic components to printed circuit boards by soldering or reflowing. During assembly, sufficient heat is applied to melt tin-silver alloy deposits and upon cooling, a metallurgical bond between the component and circuit board is formed. Eutectic tin-silver contains 96.5% tin and 3.5% silver, and becomes liquidus at a temperature of 221° C. A number of references disclose electrolytes for depositing silver-tin alloys, including U.S. Pat. No. 5,514,261 and DE patent application 4,330,068.

The electrodeposition of tin-rich alloys of tin-silver is difficult given the large difference in reduction potential between the two metals. Furthermore, the preferential reduction of tin is made more difficult by the fact that silver exists in solution as a monovalent ion, whereas tin is either divalent or tetravalent, and thereby requires two or four times the amount of current for reduction to occur, relative to silver. In addition, an appreciable amount of silver is included in solution to allow for the practical operation of the electrolyte on a production scale. Accordingly, there remains a need in the art for electrolytes that enhance the deposition of tin-silver alloys on a substrate.

SUMMARY OF THE INVENTION

A tin-silver electrolyte includes a tin compound; a silver compound, and a mesoionic compound in a sufficient amount to enhance deposition of a tin-silver alloy on a substrate. Mesoionic compounds may include triazoliums, tetrazoliums, sydnones, or any suitable mesoionic compound that enhances deposition of a tin-silver alloy on a substrate. A suitable triazolium compound has structure (I):

(I)

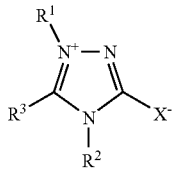

wherein $R^1$ is a substituted or unsubstituted alkyl group having from 1 to 28 carbon atoms; a substituted or unsubstituted alkenyl group having from 1 to 28 carbon atoms; a substituted or unsubstituted cycloalkyl group having from 3 to 28 carbon atoms; a substituted or unsubstituted aryl group having from 6 to 33 carbons; a substituted or unsubstituted heterocyclic ring having from 1 to 28 carbon atoms and one or more hetero atoms, including N, O, or S; an alkyl, cycloalkyl, alkenyl, alkoxyalkyl, aryl, or phenoxy group connecting to a substituted or unsubstituted aromatic ring; or an alkyl, cycloalkyl, alkenyl, alkoxyalkyl, aryl, or phenoxy group connecting to a substituted or unsubstituted heterocyclic ring having 1 to 28 carbon atoms and one or more heteroatoms such as N, O, or S;

$R^2$ is a substituted or unsubstituted amine group having from 0 to 25 carbon atoms; a substituted or unsubstituted alkyl, alkenyl, or alkoxy group having from 1 to 28 carbon atoms; a substituted or unsubstituted cycloalkyl group having from 3 to 28 carbon atoms; a substituted or unsubstituted acyloxy group having from 2 to 25 carbon atoms; a substituted or unsubstituted aryl group having from 6 to 33 carbon atoms; a substituted or unsubstituted heterocyclic ring having from 1 to 28 carbon atoms and one or more hetero atoms, including N, O, or S; an alkyl, cycloalkyl, alkenyl, alkoxyalkyl, aryl, or phenoxy group connecting to a substituted or unsubstituted aromatic ring; or an alkyl, cycloalkyl, alkenyl, alkoxyalkyl, aryl, or phenoxy group connecting to a substituted or unsubstituted heterocyclic ring having from 1 to 25 carbon atoms and one or more hetero atoms including N, O, or S;

$R^3$ is a substituted or unsubstituted amine group having from 0 to 25 carbon atoms; a substituted or unsubstituted alkyl, alkoxy, or alkenyl group having from 1 to 28 carbon atoms; a substituted or unsubstituted cycloalkyl group having from 3 to 28 carbon atoms; a substituted or unsubstituted acyloxy group having from 2 to 25 carbon atoms; a substituted or unsubstituted aryl group having from 6 to 33 carbon atoms; a substituted or unsubstituted heterocyclic ring having from 1 to 28 carbon atoms and one or more hetero atoms, including N, O, or S; an alkyl, cycloalkyl, alkenyl, alkoxyalkyl, aryl, or phenoxy group connecting to a substituted or unsubstituted aromatic ring; or an alkyl, cycloalkyl, alkoxyalkyl, aryl, or phenoxy group connecting to a substituted or unsubstituted heterocyclic ring having from 1 to 25 carbon atoms and containing one or more hetero atoms including N, O, or S; $R^1$, $R^2$, or $R^3$ may further combine with each other to form a 5-, 6-, or 7-membered ring; and X is a moiety covalently bound to the ring and may be negatively charged, for example a chalcone such as a sulfur atom or oxygen atom.

A suitable tetrazolium compound has structure (II):

(II)

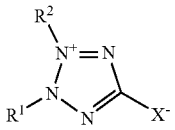

wherein $R^1$, $R^2$, and X are as defined above.

A suitable sydnone has structure (III):

(III)

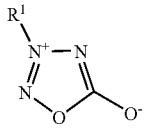

wherein $R^1$ is as defined above.

Another embodiment of the present invention is directed to a method for depositing a tin-silver alloy on a substrate which includes contacting the substrate with the above-described electrolyte composition, and generating a current through the electrolyte at a suitable current density to deposit tin-silver alloy on the substrate. The method may be employed in depositing a tin-silver alloy on a metal or dielectric substrate such as in the manufacture of semiconductors and printed wiring boards.

A further embodiment of the present invention includes an article of manufacture having a coating composed of from 90 to 99.9 weight percent tin, and from 0.1 to 10 weight percent silver.

DETAILED DESCRIPTION OF THE INVENTION

A tin-silver electrolyte includes a tin compound, a silver compound, and one or more mesoionic compound in an amount sufficient to enhance deposition of a tin-silver alloy on a substrate. The term "enhance" within the scope of the present invention means that during plating the reduction potential of silver complexed with a mesoionic compound is shifted towards the reduction potential of the tin. The shifting of the reduction potential of the complexed silver to tin favors deposition of a tin rich alloy of tin-silver on a substrate. The term "electrolyte" within the scope of the present invention means a composition that may be employed to deposit a metal or metal alloy on a substrate. All numerical ranges are inclusive and combinable in any order, except where it is logical that such numerical ranges are constrained to add up to 100%.

Mesoionic compounds are dipolar, five- or six-membered heterocyclic compounds in which both the negative and the positive charge are delocalized, and for which neither a totally covalent structure or any one polar structure may be satisfactorily written. The formal positive charge is generally associated with the ring atoms, while the formal negative charge is associated with ring atoms or an exocyclic heteroatom such as oxygen or sulfur. Any mesoionic compound that enhances deposition of a tin-silver alloy on a substrate may be employed to practice the present invention. While not being bound by any particular theory, the inventors of the present invention believe that the mesoionic compounds form a complex with silver. The formation of the complex shifts the reduction potential towards the reduction potential of tin, thus enabling a tin rich deposit of a tin-silver alloy. Such complexes may be formed even at low pH values. Examples of suitable mesoionic compounds that may be employed to practice the present invention include, but are not limited to, triazolium compounds, tetrazolium compounds or sydnone compounds. A preferred mesoionic compound has structure (I):

(I)

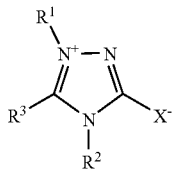

wherein $R^1$ is a substituted or unsubstituted alkyl group having from 1 to 28, and preferably from 1 to 8 carbon atoms; substituted or unsubstituted alkenyl group having from 1 to 28, and preferably from 1 to 8 carbon atoms; a substituted or unsubstituted cycloalkyl group having from 3 to 28 carbon atoms; or a substituted or unsubstituted aryl group having from 6 to 33, and preferably from 6 to 12 carbon atoms; and a substituted or unsubstituted heterocyclic ring having from 1 to 28, preferably from 1 to 14 carbon atoms and one or more hetero atoms, including N, O, or S. Exemplary substitutions include, but are not limited to, an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group. Exemplary alkyl groups include methyl, ethyl, propyl, butyl, or 2-ethylhexyl; exemplary alkenyl groups include allyl; and exemplary cycloalkyl groups include cycloalkyl; exemplary aryl groups include phenyl, or 4-methylenedioxyphenyl, 3-sulfamoylphenyl; exemplary heterocyclic rings are 4-pyridyl.

$R^1$ may further be an alkyl, cycloalkyl, alkenyl, alkoxyalkyl, aryl, or phenoxy group connecting to a substituted or unsubstituted aromatic ring such as phenyl, naphthyl; or an alkyl, cycloalkyl, alkenyl, alkoxyalkyl, aryl, or phenoxy group connecting to a substituted or unsubstituted heterocyclic ring having one or more heteroatoms including N, O, or S and having 1 to 25, and preferably 2 to 10 carbon atoms. Exemplary substitutions for the aromatic ring or heterocyclic ring include but are not limited to an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group.

$R^2$ is a substituted or unsubstituted amine group having from 0 to 25, preferably from 0 to 8, carbon atoms; a substituted or unsubstituted acyloxy group having from 2 to 25, preferably from 2 to 8, carbon atoms; a substituted or unsubstituted alkoxy group having from 1 to 28, preferably from 1 to 8 carbon atoms; a substituted or unsubstituted alkyl group having from 1 to 28, preferably from 1 to 8 carbon atoms; a substituted or unsubstituted alkenyl group having from 1 to 28, and preferably from 1 to 8 carbon atoms; a substituted or unsubstituted cycloalkyl group having from 3 to 28 carbon atoms; a substituted or unsubstituted aryl group having from 6 to 33, preferably from 6 to 12 carbon atoms; or a substituted or unsubstituted heterocyclic ring having from 1 to 28, preferably from 1 to 14 carbon atoms and one or more hetero atoms, including N, O, or S.

Exemplary substitutions on $R^2$ groups include, but are not limited to, an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group. Exemplary amino groups include amino, methylamino, ethylamino, or 2-ethylhexylamino; exemplary acyloxy groups include acetoxy and benzoyloxy; exemplary alkoxy groups include methoxy; exemplary alkyl groups include methyl, ethyl, propyl, butyl, 2-ethylhexyl, and the like; exemplary alkenyl groups include allyl; and exemplary cycloalkyl groups include cycloalkyl; exemplary aryl groups include phenyl, 4-methylenedioxyphenyl, or 3-sulfamoylphenyl; and exemplary heterocyclic rings are 4-pyridyl or 2-pyridyl.

$R^2$ may further be an alkyl, cycloalkyl, alkenyl, alkoxyalkyl, aryl, or phenoxy group connecting to a substituted or unsubstituted aromatic ring such as phenyl, naphthyl; or an alkyl, cycloalkyl, alkenyl, alkoxyalkyl, aryl, or phenoxy group connecting to a substituted or unsubstituted heterocyclic ring containing one or more heteroatoms including N, O, or S and having 1 to 25, and preferably 2 to 10 carbon atoms. Exemplary substitutions for the aromatic ring or heterocyclic ring include, but are not limited to, an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, or a hydroxyl group, (e.g., 2-(1',5'-dimethyl-1',2',4'-triazolium-3'-thiolate-4'-)ethyl).

$R^3$ is a substituted or unsubstituted amine group having from 0 to 25, preferably from 0 to 8, carbon atoms; a substituted or unsubstituted acyloxy group having from 2 to 25, preferably from 2 to 8, carbon atoms; a substituted or unsubstituted alkoxy group having from 1 to 28, preferably from 1 to 8 carbon atoms; a substituted or unsubstituted alkyl group having from 1 to 28, preferably from 1 to 8 carbon atoms; a substituted or unsubstituted alkenyl group having from 1 to 28, preferably from 1 to 8 carbon atoms; a substituted or unsubstituted cycloalkyl group having from 3 to 28 carbon atoms; a substituted or unsubstituted aryl group having from 6 to 33, and preferably from 6 to 12 carbon atoms; or a substituted or unsubstituted heterocyclic ring having from 1 to 28, preferably from 1 to 14 carbon atoms and one or more hetero atoms, including N, O, or S.

Exemplary substitutions on $R^3$ groups include, but are not limited to, an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group. Exemplary amino groups include amino, methylamino, ethylamino, or 2-ethylhexylamino; exemplary acyloxy groups include acetoxy and benzoyloxy; exemplary alkoxy groups include methoxy; exemplary alkyl groups include methyl, ethyl, propyl, butyl, or 2-ethylhexyl; exemplary alkenyl groups include allyl; exemplary cycloalkyl groups include cycloalkyl; exemplary aryl groups include phenyl, 4-methylenedioxyphenyl, or 3-sulfamoylphenyl; and exemplary heterocyclic rings are 4-pyridyl or 2-pyridyl.

$R^3$ may further be an alkyl, cycloalkyl, alkenyl, alkoxyalkyl, aryl, or phenoxy group connecting to a substituted or unsubstituted aromatic ring such as phenyl, naphthyl; or an alkyl, cycloalkyl, alkenyl, alkoxyalkyl, aryl, or phenoxy group connecting to a substituted or unsubstituted heterocyclic ring containing one or more heteroatoms including N, O, or S and having 1 to 25, preferably 2 to 10 carbon atoms. Exemplary substitutions for the aromatic ring or heterocyclic ring include, but are not limited to, an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, or a hydroxyl group.

$R^1$, $R^2$, or $R^3$ may be taken together to form a 5-, 6-, or 7-membered ring. Preferably, $R^1$, $R^2$, and $R^3$ are methyl.

X is a moiety covalently bound to the ring and may be negatively charged, for example a chalcone such as a sulfur atom, selenium atom, or oxygen atom. Sulfur and oxygen are preferred.

Specific examples of such triazolium compounds of formula (I) include, but are not limited to, 1,2,4-triazolium-3-thiolates such as 1,4,5-trimethyl-1,2,4-triazolium-3-thiolate, 1,5-dimethyl-4-(2-methoxyethyl)-1,2,4-triazolium-3-thiolate, 1,5-dimethyl-4-amino-1,2,4-triazolium-3-thiolate, 1,5-dimethyl-4-allyl-1,2,4-triazolium-3-thiolate, 1-methyl-4-(2-methoxyethyl)-5-phenyl-1,2,4-triazolium-3-thiolate, 1,5-dimethyl-4-isopropyl-1,2,4-triazolium-3-thiolate, 1-methyl-4,5-diphenyl-1,2,4-triazolium-3-thiolate, 1,5-dimethyl-4-phenyl-1,2,4-triazolium-3-thiolate, 1,5-dimethyl-4-ethyl-1,2,4-triazolium-3-thiolate, or 1,5-dimethyl-4-(2,2-dimethoxyethyl)-1,2,4-triazolium-3-thiolate. Preparation of 1,2,4-triazolium-3-thiolates is disclosed in U.S. Pat. No. 4,378,424.

Another example of a suitable mesoionic compound is a tetrazolium compound having structure (II):

(II)

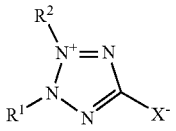

wherein $R^1$, $R^2$, and X are as defined above.

A further example of a suitable mesoionic compound is a sydnone having structure (III):

(III)

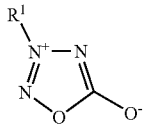

wherein $R^1$ is as defined above. In these types of structures, the negative and positive charges are also delocalized, although the structure is theoretically a major contributor.

Examples of suitable sydnones of formula (III) that may be employed to practice the present invention include, but are not limited to, 3-methylsydnone, 3-pentylsydnone, 3-dodecylsydnone, 3-(3',4'-dichlorophenyl)sydnone, 3-thionylsydnone, 3-furfirrylsydnone, 3-naphthylsydnone, 3-phenyl-4-methylsydnone, 3,4-diphenylsydnone, 3-phenyl-4-methylsydnone, 3,4-diethylsydnone, or 3-(4'-(3"-sydnone) phenyl)sydnone.

Many of the foregoing mesoionic compounds of formulae (I), (II), and (III) are commercially available or may be prepared by the processes listed in U.S. Pat. No. 5,401,621, or U.S. Pat. No. 4,378,424 as mentioned above.

Effective concentrations of the mesoionic stabilizing agent range from 1 to 100 mole equivalents relative to silver, preferably from 2 to 4 mole equivalents relative to silver.

Any tin compound that provides tin ions that may be deposited on a substrate with silver ions to form a tin-silver alloy film or coating may be used. The one or more tin compounds useful in the present invention are any solution soluble tin compound. Suitable tin compounds include, but are not limited to salts, such as tin halides, tin sulfates, tin alkane sulfonate such as tin methane sulfonate, tin aryl sulfonate such as tin phenyl sulfonate and tin toluene sulfonate, tin alkanol sulfonate, and the like. When tin halide is used, it is preferred that the halide is chloride. It is preferred that the tin compound is tin sulfate, tin chloride, tin alkane sulfonate or tin aryl sulfonate, and more preferably tin sulfate or tin methane sulfonate. The tin compounds useful in the present invention are generally commercially available from a variety of sources and may be used without further purification. Alternatively, the tin compounds useful in the present invention may be prepared by methods known in the literature.

Tin concentrations in electrolytes may range from 5 to 80 g/L (grams/liter), and may be, for example, from 5 to 25 g/L for low speed processes and 30 to 70 g/L for high-speed processes.

Any silver compound that provides silver ions that may be deposited on a substrate with tin ions to form a tin-silver alloy film or coating may be used, with salts of halides or acids being typical. Examples of suitable silver compounds include, but are not limited to, salts such as silver nitrate, silver methane sulfonate, silver iodide, silver chloride, silver sulfate, or mixtures thereof. Silver methane sulfonate is a preferred silver salt. Silver concentrations in electrolytes may range from 0.1 to 10 g/L, and may be, for example, 4 to 8 g/L for high-speed processes.

Diluents employed to practice the present invention include water, organic solvents, or mixtures thereof. Typical organic diluents are those that are water-soluble such as alcohols.

In addition to the tin and silver compounds, one or more mesoionic compound and a suitable diluent, electrolytes of the present invention also may include one or more "adjuvants". Adjuvants within the scope of the present invention are additives or compounds that may be added to the electrolyte in addition to the primary ingredients (tin and silver compounds, mesoionic compounds and diluent), which contribute to the effectiveness of the primary ingredients. Examples of suitable adjuvants include, but are not limited to, brighteners, antioxidants, surfactants, grain refiners, conductivity acids and their salts, mixtures thereof, or other compounds and additives as discussed below. The list of adjuvants is not exhaustive and any compound or element that improves the effectiveness of tin-silver deposition may be employed to practice the present invention. Such adjuvants may be employed in conventional amounts.

Reducing agents may be added to the electrolyte composition of the present invention to assist in keeping the tin in a soluble, divalent state. Suitable reducing agents include, but are not limited to, hydroquinone and hydroxylated aromatic compounds, such as resorcinol, catechol, and the like. Such reducing agents are disclosed in U.S. Pat. No. 4,871,429. Other suitable reducing agents or antioxidants include, but are not limited to, vanadium compounds. One such vanadium compound is vanadylacetylacetonate, another is vanadium triacetylacetonate. Others include, but are not limited to, vanadium halides, vanadium oxyhalides, vanadium alkoxides or vanadyl alkoxides or vanadium triacetyl-acetonate. The amount of such reducing agent is well known to those skilled in the art, but is typically in the range of from about 0.1 g/L to about 5 g/L.

It will be appreciated by those skilled in the art that hydroxy aromatic compounds or other wetting agents may be added to the electrolyte compositions of the present invention to provide further grain refinement. Such grain refiners may be added to the electrolyte composition of the present invention to further improve deposit appearance and operating current density range. Suitable other wetting agents include, but are not limited to: alkoxylates, such as the polyethoxylated amines JEFFAMINE T-403 or TRITON RW, or sulfated alkyl ethoxylates, such as TRITON QS-15, and gelatin or gelatin derivatives. The amounts of such grain refiners useful in the present invention are well known to those skilled in the art and typically are in the range of 0.01 to 20 mL/L, preferably 0.5 to 8 mL/L, and more preferably 1 to 5 mL/L.

Other adjuvants that may be present include a mercapto group containing aromatic compound, dioxyaromatic compound, and unsaturated carboxylic acid. Such adjuvants prevent an occurrence of acicular, dendrite, whisker-like, granular, or powdery deposits in the order of several microns to several millimeters and/or burnt deposits on an end portion or edge portion or over the entire surface of a substrate to be plated.

Examples of mercapto group containing aromatic compounds may include 2-mercaptobenzoic acid, mercaptophenol, 2-mercaptobenzooxazole, and 2-mercaptobenzothiazole. The content of the additives may be in a range of 0.01 to 20 g/L, preferably, in a range of 0.01 to 5 g/L. Specific examples of the dioxyaromatic compounds may include dioxybenzophenone, 3,4-dioxyphenylalanine, resorcin, catechol, hydroquinone, and diperine. The content of the dioxyaromatic compounds may be in a range of 0.001 to 20 g/L, preferably, in a range of 0.001 to 4 g/L. Examples of unsaturated carboxylic acids may include benzoic acid, fumaric acid, phthalic acid, acrylic acid, citraconic acid, and methacrylic acid. The content of the unsaturated carboxylic acids may be in a range of 0.01 to 10 g/L, preferably, in a range of 0.01 to 2 g/L.

When lustrous surfaces are desired, brighteners may be employed. Suitable brighteners include, but are not limited to, aldehydes, ketones, carboxylic acids, carboxylic acid derivatives, amines or mixtures thereof. Specific examples of suitable brighteners may be found in U.S. Pat. No. 4,582,576 and U.S. Pat. No. 4,246,077. Such brighteners may be employed in amounts of 50 mg/L (milligrams/liter) to 5 grams/L of electrolytic solution, typically from 100 mg/L to 250 mg/L. Compounds of iron, cobalt, nickel, zinc, gallium, arsenic, selenium, palladium, cadmium, indium, antimony, tellurium, thallium, lead and bismuth also are suitable. Polyethylene glycols and their derivatives, such as polyethyleneglycol ethers, to the extent that they are water-soluble also are suitable brighteners. Polyethylene glycols and their derivatives may be employed as the only brighteners or they may be employed with the other brighteners disclosed above.

Conductivity acids and conductivity salts for the bath also may be employed and include, but are not limited to, boric acid, carboxylic acids, hydroxy acids, and salts of these acids to the extent they are water-soluble. Preferred are formic acid, acetic acid, oxalic acid, citric acid, malic acid, tartaric acid, gluconic acid, glucaric acid, glucuronic acid and salts of these acids such conductivity acids and salts are employed in conventional amounts.

Any substrate that may be plated with a tin-silver film or coating may be employed to practice the present invention. Such substrates include, but are not limited to, electric/electronic parts for soldering, such as chip parts, hoop parts, lead frames, semiconductor packages, bumps, and printed wiring boards. Such substrates may be metal or dielectric. When the substrate is a dielectric, a conductive electroless layer, conductive seed layer or conductive polymer may be provided as part of the dielectric substrate such that tin-silver may be readily deposited on the dielectric. Electroless plating technology, seed layer technology and conductive polymers are well known in the art. Any suitable electroless layer, seed layer or conductive polymer may be employed.

The present invention also is directed to an article of manufacture having a film or coating disposed on a surface of the article. The surface of the article may have a coating of from 90 to 99.9 weight percent of tin and from 0.1 to 10 weight percent silver. Such articles include, but are not limited to, the specific substrates listed above.

Any plating method using the electroplating bath of the present invention may be employed. Examples of such methods include, but are not limited to, rack plating, barrel plating, and high speed plating such as hoop plating or jet plating.

A cathode current density ($D_K$) is suitably selected in a range of 0.1 to 30 A/dm$^2$ (amperes/decimeter squared) depending on the plating method. For example, in the case of rack plating, it may be in a range of 0.5 to 4 A/dm$^2$, preferably, in a range of 1 to 3 A/dm$^2$, and in the case of barrel plating, it may be in a range of 0.1 to 1 A/dm$^2$, preferably, in a range of 0.2 to 0.5 A/dm$^2$.

As the anode, there may be used a soluble anode made from tin, silver, or a tin-silver alloy; or an insoluble anode formed of a platinum plated titanium plate, platinum plate, or carbon plate. In addition, to keep a suitable ratio between $Sn^{2+}$ and $Ag^{+}$ in the plating bath, replenishment, at a suitable interval, of a silver salt in the case of using tin as the anode plate; of a stannous salt in the case of using silver as the anode plate; and a stannous salt and a silver salt in the case of using the insoluble anode. A tin anode is the preferred anode.

According to another method, there is provided a tin-silver alloy electroplating process (1) including the steps of:

dipping a substrate to be plated in a tin-silver alloy electroplating bath containing a stannous salt, a silver salt, and one or more mesoionic compounds, a wetting agent and an antioxidant; and electroplating the substrate dipped in the electroplating bath;

wherein tin metal is used as an anode and the amount of tin ions consumed by deposition of tin from the electroplating bath is replenished by electrolytic elusion of the tin anode; and the amount of silver ions consumed by deposition of silver from the electroplating bath is replenished by addition of a silver salt in the electroplating bath.

Another method provides a tin-silver alloy electroplating process (2) including the steps of:

dipping a substrate to be plated in a tin-silver alloy electroplating bath containing a stannous salt, a silver salt, one or more mesoionic compounds and one or more wetting agents and antioxidants; and electroplating the substrate dipped in the electroplating bath;

wherein the substrate is dipped in the electroplating bath while being applied with a current; and the substrate having been plated is lifted up from the electroplating bath while being applied with a current. Preferably, a tin anode is used.

A further method also provides a tin-silver alloy electroplating process (3) including the steps of:

dipping a substrate to be plated in a tin-silver alloy electroplating bath containing a stannous salt, a silver salt, one or more mesoionic compounds and one or more wetting agents and antioxidants; and electroplating the substrate dipped in the electroplating bath; and tin metal may be used as an anode and the amount of tin ions consumed by deposition of tin from the electroplating bath is replenished by electrolytic elusion of the tin anode, and the amount of silver ions consumed by deposition of silver from the electroplating bath is replenished by addition of a silver salt in the electroplating bath; and the substrate is dipped in the electroplating bath while being applied with a current, and the substrate having been plated is lifted up from the electroplating bath while being applied with a current.

Electrolytes of the present invention may be employed at pH ranges of from less than 1 to 14, preferably from less than 1 to 9, more preferably less than 1. In general, a low pH of 1 or less, preferably less than 1 is useful for high-speed processes (e.g., where the applicable current density is in the range of 5 to 30 A/dm$^2$ (5 to 30 amperes/decimeter squared). Low speed processes are generally run at a pH of greater than 1 and at current densities below 5 A/dm$^2$. The operating temperature ranges are typically from 20° C. to 60° C., typically from 20° C. to 45° C.

Electrolytes of the present invention provide tin rich coatings of tin-silver alloys. The mesoionic compounds are believed to complex with silver ions that shift the reduction potential of the complex toward that of tin, thus providing a tin-rich tin-silver alloy. Additionally, mesoionic compounds may complex silver ions at low pH values as low as 1 or below, thus electrolytes of the present invention are highly suitable for high speed plating. Electrolytes also operate at broader temperature ranges than many conventional tin-silver electrolytes. Electrolytes of the present invention may operate over an extended current density range in contrast to many conventional tin-silver electrolytes.

While the invention has been described with reference to an exemplary embodiment, it is understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

EXAMPLE 1

A solution of water and
10 g/L silver as silver methane sulfonate,
10 g/L tin as tin methane sulfonate,
20 g/L 1,4,5 trimethyl-1,2,4-triazolium-3-thiolate,
20 g/L potassium salt of D-gluconic acid,
0.2 g/L vanadylacetylacetonate is prepared; the pH value of the solution is set to 1 by means of a mixture of potassium hydroxide and ammonium hydroxide (weight ratio 1:1).

Uniform and lustrous coatings of a tin-silver alloy of 10 weight % of silver and 90 weight % of tin are deposited from the bath on copper substrates at a bath temperature of 30° C. and a current density of 5 A/dm$^2$.

EXAMPLE 2

A solution of water and
8 g/L silver as silver nitrate,
30 g/L tin as tin aryl-sulfonate,
30 g/L 1,5 dimethyl-4-(-methoxyethyl)-1,2,4-triazolium-3-thiolate,
0.1 g/L vanadium triacetylacetonate,
40 g/L ethoxylated/propoxylated butanol is prepared; the pH value of the solution is set to 1.9 by means of a mixture of potassium hydroxide and ammonium hydroxide (weight ratio 1:1).

Uniform and lustrous coatings of a tin-silver alloy of 0.1 weight % of silver and 99.9 weight % of tin are deposited from the bath on dielectric substrates at a bath temperature of 60° C. and a current density of 4 A/dm$^2$.

EXAMPLE 3

A solution of water and
3 g/L silver as silver sulfate,
10 g/L tin as tin sulfate,
40 g/L 3-methylsydnone,
0.4 g/L vanadium alkoxide, 20 ppm dihydroxynaphthaline,
0.5 g/L methyl-polymer with oxirane monobutylether is prepared; the pH value of the solution is set to 3.2 by means of a mixture of potassium hydroxide and ammonium hydroxide (weight ratio 1:1).

Uniform and lustrous coatings of a tin-silver alloy of 5 weight % of silver and 95 weight % of tin are deposited from the bath on nickel substrates at a bath temperature of 40° C. and a current density of 1 A/dm$^2$.

EXAMPLE 4

A solution of water and
1 g/L silver as silver chloride,
5 g/L tin as tin phenylsulfonate,
40 g/L 3-pentylsydnone,
0.3 g/L vanadyl alkoxide,
5 g/L ethoxylated/propoxylated copolymer,
20 g/L D-gluconic acid is prepared; the pH value of the solution is set to 5.0 by means of a mixture of potassium hydroxide and ammonium hydroxide (weight ratio 1:1).

Uniform and lustrous coatings of a tin-silver alloy of 2 weight % of silver and 98 weight % of tin are deposited from the bath on dielectric substrates at a bath temperature of 50° C. and a current density of 3 A/dm$^2$.

EXAMPLE 5

A solution of water and
3 g/L silver as silver iodide,
6 g/L tin as tin methane sulfonate,
50 g/L 1,5-dimethyl4-amino-1,2,4-triazolium-3-thiolate,
5 mL/L polyethoxylatedamine,
2 g/L catechol,
10 g/L boric acid is prepared; the pH value of the solution is set to 10.3 by means of potassium hydroxide.

Uniform and lustrous coatings of a tin-silver alloy of 3 weight % of silver and 97 weight % of tin are deposited from the bath on zinc substrates at a bath temperature of 20° C. and a current density of 2 A/dm$^2$.

EXAMPLE 6

A solution of water and
8 g/L silver as diamine silver nitrate,
50 g/L tin as tin sulfate,
10 g/L 1,5-dimethyl-4-allyl-1,2,4-triazolium-3-thiolate,
50 g/L resorcinol,
8 mL/L sulfate alkyl ethoxylate is prepared; the pH value of the solution is set to 4 by means of potassium hydroxide.

Uniform and lustrous coatings of a tin-silver alloy of 10 weight % of silver and 90 weight % of tin are deposited from the bath at a bath temperature of 40° C. and a current density of 0.5 A/dm$^2$ on electrolessly plated dielectric substrates.

EXAMPLE 7

A solution of water and
5 g/L silver as silver methane sulfonate,
40 g/L tin as tin methane sulfonate,
50 g/L 3-dodecylsydnone,
0.5 g/L vanadium oxychloride,
1 g/L methyl-polymer with oxirane monobutylether is prepared; the pH value of the solution is set to 0.7.

Uniform and lustrous coatings of a tin-silver alloy of 10 weight % of silver and 90 weight % of tin are deposited from the bath on conductive polymer coated dielectrics at a bath temperature of 25° C. and a current density of 6 A/dm$^2$.

EXAMPLE 8

A solution of water and
7 g/L silver as silver sulfate,
35 g/L tin as tin sulfate,
25 g/L 3-thionylsydnone,
5 g/L hydroquinone,
1 mL/L gelatin,
0.1 g/L polyethyleneglycol ether is prepared; the pH value of the solution is 0.3.

Uniform and lustrous coatings of a tin-silver alloy of 10 weight % of silver and 90 weight % of tin are deposited from the bath on seed layer coated dielectrics at a bath temperature of 25° C. and a current density of 6 A/dm$^2$.

EXAMPLE 9

A solution of water and
10 g/L silver as silver nitrate,
25 g/L tin as tin methane sulfonate,
15 g/L 1-methyl-4-(2-methoxyethyl)-5-phenyl-1,2,4-triazolium-3-thiolate,
0.2 g/L vanadylacetylacetonate,
5 g/L 2-mercaptobenzoic acid is prepared; the pH value of the solution is set to 7.8 by means of a mixture of potassium hydroxide and ammonium hydroxide (weight ratio 1:1).

Uniform and lustrous coatings of a tin-silver alloy of 5 weight % of silver and 95 weight % of tin are deposited from the bath on lead frame substrates at a bath temperature of 30° C. and a current density of 2 A/dm$^{2,}$ Uniform and lustrous coatings of a tin-silver alloy of 5 weight % of silver and 95 weight % of tin are deposited on lead frame substrates at a bath temperature of 30° C. and a current density of4 A/dm$^2$.

EXAMPLE 10

A solution of water and
10 g/L silver as silver chloride
20 g/L tin as tin methane sulfonate,
10 g/L 3-furfurylsydnone,
10 g/L acetic acid,
0.5 g/L vanadylacetylacetonate is prepared; the pH value of the solution is set to 7.1 by means of a mixture of potassium hydroxide and ammonium hydroxide (weight ratio 1:1).

At a bath temperature of 40° C. and a current density of 0.5 A/dm$^{2,}$ uniform and lustrous coatings are deposited, and a current density of 2 A/dm$^2$. Uniform and mat coatings are deposited on copper coated printed wiring boards of a tin-silver alloy of 10 weight % of silver and 90 weight % of tin.

EXAMPLE 11

A solution of water and
10 g/L silver as silver chloride,
5 g/L tin as tin chloride, 40 g/L 1,5-dimethyl-4-ethyl-1,2,4-triazolium-3-thiolate,
20 g/L mercaptophenol is prepared; the pH value of the solution is set to 7.0 by means of a mixture of sodium hydroxide and ammonium hydroxide (weight ratio 1:1).

Uniform and lustrous coatings of a tin-silver alloy of 5 weight % of silver and 95 weight % of tin are deposited from the bath at a bath temperature of 40° C. and a current density of 0.5 A/dm$^2$ on conductive polymer substrates.

EXAMPLE 12

A solution of water and
4 g/L silver as silver methane sulfonate,
70 g/L tin as tin methane sulfonate,
10 g/L 1,4,5 trimethyl-1,2,4-triazolium-3-thiolate,
4 g/L ethoxylated/propoxylated butanol with a M. W. of 900,
0.5 g/L methyl-polymer with oxirane monobutylether,
20 ppm dihydroxynaphthaline,
0.2 g/L vanadylacetylacetonate is prepared; the pH value of the solution is set to 0.1 with an organic acid.

Uniform and lustrous coatings of a tin-silver alloy of 2 weight % of silver and 98 weight % of tin are deposited from the bath on printed wiring board substrates at a bath temperature of 30° C. and a current density of 6 A/dm$^2$.

EXAMPLE 13

A solution of water and
2 g/L silver as silver methane sulfonate,
60 g/L tin as tin methane sulfonate,
8 g/l tetrazolium
5 g/L ethoxylated/propoxylated copolymer,
30 ppm dihydroxynaphthaline,
0.4 g/L vanadium triacetyl-acetonate is prepared; the pH value of the solution is set to 0.2 with an organic acid.

The tetrazolium has the formula of formula (II), where $R_1$ and $R_2$ are unsubstituted ethyl groups.

Uniform and lustrous coatings of a tin-silver alloy of 90 weight % of tin and 10 weight % of silver are deposited from the bath on seed layer coated dielectric substrates at a bath temperature of 40° C. and a current density of 7 A/dm$^2$.

EXAMPLE 14

A solution of water and
4 g/L silver as silver methane sulfonate,
65 g/L tin as tin methane sulfonate,
12 g/l tetrazolium
5 g/L ethoxylated/propoxylated copolymer,
0.5 g/L methyl-polymer with oxirane monobutylether,
0.3 g/L vanadium alkoxide is prepared; the pH value of the solution is set to 0.5.

The tetrazolium has the formula of formula (II), where $R_1$ and $R_2$ are unsubstituted propyl groups.

Uniform and lustrous coatings of a tin-silver alloy of 8 weight % of silver and 92 weight % of tin are deposited from the bath on a lead frame substrate at a bath temperature of 40° C. and a current density of 12 A/dm$^2$.

What is claimed is:

1. An electrolyte comprising a tin compound, a silver compound, and a mesoionic compound in an amount sufficient to enhance deposition of a tin-silver alloy on a substrate, the mesoionic compound is a triazolium compound, a tetrazolium compound, a sydnone compound, or mixtures thereof.

2. The electrolyte of claim 1, wherein the triazolium compound has a formula:

(I)

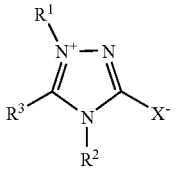

wherein $R^1$ is a substituted or unsubstituted alkyl group having from 1 to 28 carbon atoms; a substituted or unsubstituted alkenyl group having from 1 to 28 carbon atoms; a substituted or unsubstituted cycloalkyl group having from 3 to 28 carbon atoms; a substituted or unsubstituted aryl group having from 6 to 33 carbons; a substituted or unsubstituted heterocyclic ring having from 1 to 28 carbon atoms and one or more hetero atoms, comprising N, O, or S; an alkyl, cycloalkyl, alkenyl, alkoxyalkyl, aryl, or phenoxy group connecting to a substituted or unsubstituted aromatic ring; or an alkyl, cycloalkyl, alkenyl, alkoxyalkyl, aryl, or phenoxy group connecting to a substituted or unsubstituted heterocyclic ring having 1 to 28 carbon atoms and one or more heteroatoms comprising N, O, or S;

$R^2$ is a substituted or unsubstituted amine group having from 0 to 25 carbon atoms; a substituted or unsubstituted alkyl, alkenyl, or alkoxy group having from 1 to 28 carbon atoms; a substituted or unsubstituted cycloalkyl group having from 3 to 28 carbon atoms; a substituted or unsubstituted acyloxy group having from 2 to 25 carbon atoms; a substituted or unsubstituted aryl group having from 6 to 33 carbon atoms; a substituted or unsubstituted heterocyclic ring having from 1 to 28 carbon atoms and one or more hetero atoms comprising N, O, or S; an alkyl, cycloalkyl, alkenyl, alkoxyalkyl, aryl, or phenoxy group connecting to a substituted or unsubstituted aromatic ring; or an alkyl, cycloalkyl, alkenyl, alkoxyalkyl, aryl, or phenoxy group connecting to a substituted or unsubstituted heterocyclic ring having 1 to 25 carbon atoms and one or more hetero atoms comprising N, O, or S;

$R^3$ is a substituted or unsubstituted amine group having from 0 to 25 carbon atoms; a substituted or unsubstituted alkyl, alkoxy, or alkenyl group having from 1 to 28 carbon atoms; a substituted or unsubstituted cycloalkyl group having from 3 to 28 carbon atoms; a substituted or unsubstituted acyloxy group having from 2 to 25 carbon atoms; a substituted or unsubstituted aryl group having from 6 to 33 carbon atoms; a substituted or unsubstituted heterocyclic ring having from 1 to 28 carbon atoms and one or more hetero atoms comprising N, O, or S; an alkyl, cycloalkyl, alkenyl, alkoxyalkyl, aryl, or phenoxy group connecting to a substituted or unsubstituted aromatic ring; or an alkyl, cycloalkyl, alkoxyalkyl, aryl, or phenoxy group connecting to a substituted or unsubstituted heterocyclic ring having 1 to 25 carbon atoms and containing one or more hetero atoms comprising N, O, or S; the $R^1$, $R^2$, or $R^3$ may further combine with each other to form a 5-, 6-, or 7-membered ring; and X is a moiety covalently bound to the ring and may be negatively charged.

3. The electrolyte of claim 1, wherein the tetrazolium compound has a formula:

(II)

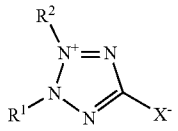

wherein $R^1$ is a substituted or unsubstituted alkyl group having from 1 to 28 carbon atoms; a substituted or unsubstituted cycloalkyl group having from 3 to 28 carbon atoms; a substituted or unsubstituted alkenyl group having from 1 to 28 carbon atoms; a substituted or unsubstituted aryl group having from 6 to 33 carbons; a substituted or unsubstituted heterocyclic ring having from 1 to 28 carbon atoms and one or more hetero atoms comprising N, O, or S; an alkyl, cycloalkyl, alkenyl, alkoxyalkyl, aryl, or phenoxy group connecting to a substituted or unsubstituted aromatic ring; or an alkyl, cycloalkyl, alkenyl, alkoxyalkyl, aryl, or phenoxy group connecting to a substituted or unsubstituted heterocyclic ring having 1 to 28 carbon atoms and one or more heteroatoms comprising N, O, or S;

$R^2$ is a substituted or unsubstituted amine group having from 0 to 25 carbon atoms; a substituted or unsubstituted alkyl, alkenyl, or alkoxy group having from 1 to 28 carbon atoms; a substituted or unsubstituted cycloalkyl group having from 3 to 28 carbon atoms; a substituted or unsubstituted acyloxy group having from 2 to 25 carbon atoms; a substituted or unsubstituted aryl group having from 6 to 33 carbon atoms; a substituted or unsubstituted heterocyclic ring having from 1 to 28 carbon atoms and one or more hetero atoms comprising N, O, or S; an alkyl, cycloalkyl, alkenyl, alkoxyalkyl, aryl, or phenoxy group connecting to a substituted or unsubstituted aromatic ring; or an alkyl, cycloalkyl, alkenyl, alkoxyalkyl, aryl, or phenoxy group connecting to a substituted or unsubstituted heterocyclic ring having 1 to 25 carbon atoms and one or more hetero atoms comprising N, O, or S; and $R^1$ and $R^2$ may further combine with each other to form a 5-, 6-, or 7-membered ring; and X is a moiety covalently bound to the ring and may be negatively charged.

4. The electrolyte of claim 1, wherein the sydnone compound has a formula:

(III)

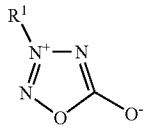

wherein $R^1$ is a substituted or unsubstituted alkyl group having from 1 to 28 carbon atoms; a substituted or unsubstituted alkenyl group having from 1 to 28 carbon atoms; a substituted or unsubstituted cycloalkyl group having from 3 to 28 carbon atoms; a substituted or unsubstituted aryl group having from 6 to 33 carbons; a substituted or unsubstituted heterocyclic ring having from 1 to 28 carbon atoms and one or more hetero atoms comprising N, O, or S; an alkyl, cycloalkyl, alkenyl, alkoxyalkyl, aryl, or phenoxy group connecting to a substituted or unsubstituted aromatic ring; or an alkyl, cycloalkyl, alkenyl, alkoxyalkyl, aryl, or phenoxy group connecting to a substituted or unsubstituted heterocyclic ring having 1 to 28 carbon atoms and one or more heteroatoms comprising N, O, or S.

5. The electrolyte of claim 1, wherein the mesoionic compound is in an amount of from 1 to 100 mole equivalents relative to silver in the electrolyte.

6. The electrolyte of claim 1, wherein tin concentration is from 5 to 80 grams/liter.

7. The electrolyte of claim 1, wherein silver concentration ranges from 0.1 to 10 grams/liter.

8. The electrolyte of claim 1, further comprising one or more adjuvants.

9. The electrolyte of claim 8, wherein the adjuvants comprise surfactants, antioxidants, brighteners, grain refiners, mercapto group containing aromatic compounds, dioxyaromatic compounds, unsaturated carboxylic acids, conducting acids and their salts, or mixtures thereof.

10. A method of depositing tin-silver alloy on a substrate comprising:

a) providing an electrolyte comprising a tin compound, a silver compound, and a mesoionic compound in an amount sufficient to enhance the deposition of tin-silver on the substrate, the mesoionic compound is a triazolium compound, a tetrazolium compound, a sydnone compound, or mixtures thereof;

b) contacting a substrate with the electrolyte; and c) generating a sufficient amount of current at a suitable current density to deposit the tin-silver alloy on the substrate.

11. The method of claim 10, wherein the mesoionic compound in the electrolyte ranges from 1 to 100 mole equivalents relative to silver.

12. The method of claim 10, wherein the current density ranges from 0.1 to 30 $A/dm^2$.

13. The method of claim 10, wherein a temperature of the electrolyte ranges from 20° C. to 60° C.

14. The method of claim 10, wherein the electrolyte further comprises one or more adjuvants.

15. The method of claim 10, wherein a pH range of the electrolyte is from less than 1 to 14.

16. The method of claim 10, wherein the substrate is a metal or dielectric.

17. A method of depositing a tin-silver alloy on a substrate comprising:

a) providing an electrolyte comprising a tin compound in an amount such that the concentration of tin ranges from 30 grams/liter to 70 grams/liter, a silver compound in an amount such that the silver concentration ranges from 4 grams/liter to 8 grams/liter, a mesoionic compound in a sufficient amount to enhance the deposition of the tin-silver alloy on the substrate, the mesoionic compound is a triazolium compound, a tetrazolium compound, a sydnone compound, or mixtures thereof, and a pH of less than 1;

b) contacting the substrate with the electrolyte; and c) depositing the tin-silver alloy on the substrate by generating a current density of 5 $A/dm^2$ to 30 $A/dm^2$.

* * * * *